US006139686A

United States Patent [19]

Trokhan et al.

[11] Patent Number: 6,139,686

[45] **Date of Patent: *Oct. 31, 2000**

[54] PROCESS AND APPARATUS FOR MAKING FORESHORTENED CELLULSIC STRUCTURE

[75] Inventors: Paul Dennis Trokhan, Hamilton; Mark Ryan Richards, Middletown; Michael Gomer Stelljes, Jr., West Chester, all of Ohio

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/994,927

[22] Filed: Dec. 19, 1997

Related U.S. Application Data

[63] Continuation-in-part of application No. 08/870,535, Jun. 6, 1997, Pat. No. 5,935,381, and a continuation-in-part of application No. 08/920,204, Aug. 15, 1997, Pat. No. 5,938,893.

[51] Int. Cl.[7] ..... D21F 11/00

[52] U.S. Cl. ..... 162/109; 162/111; 162/112; 162/113; 162/117; 162/205; 162/206; 162/207

[58] Field of Search ..... 162/109, 111, 162/112, 113, 117, 116, 205, 206, 207

[56] References Cited

U.S. PATENT DOCUMENTS

| | | | |
|---|---|---|---|
| 2,008,181 | 7/1935 | Kemp | 162/281 |
| 3,476,644 | 11/1969 | Krehnbrink | 162/280 |
| 3,812,000 | 5/1974 | Salvucci, Jr. et al. . | |
| 3,821,068 | 6/1974 | Shaw . | |
| 4,112,586 | 9/1978 | Lehtinen . | |

(List continued on next page.)

FOREIGN PATENT DOCUMENTS

| | | |
|---|---|---|
| 0 326 348 | 8/1989 | European Pat. Off. . |
| 0 617 164 A1 | 9/1994 | European Pat. Off. . |
| 0 745 717 A1 | 12/1996 | European Pat. Off. . |

(List continued on next page.)

OTHER PUBLICATIONS

*The effect of Condebelt drying on the structure of fiber bonds*, L. Kunnas et al., vol. 76, No. 4, Tappi Journal, pp. 95–104.

InterOffice Memo. Information which is believed not to be relevant has been redacted.

(List continued on next page.)

*Primary Examiner*—Peter Chin

*Attorney, Agent, or Firm*—Vladimir Vitenberg; Larry L. Huston

[57] ABSTRACT

A process and an apparatus for making a foreshortened paper web are disclosed. A wet web disposed on a fluid-permeable papermaking fabric is being pressed between two parallel and mutually opposed first and second press surfaces, the first press surface contacting the web, and the second press surface contacting the fabric. In the continuous process, the press surfaces, the web and the fabric move in a machine direction. Under pressure, at least selected portions of the web become densified and adhered to the first press surface which can be treated with a creping adhesive. The first surface is heated to create a temperature differential between two surfaces. The temperature differential causes the water contained in the web to move from the web into the fabric, thereby drying the web. After the web is released from the pressure, the web is foreshortened either by creping or by transferring the web to a slower moving transfer fabric. Creping is performed with a creping doctor blade juxtaposed with the creping surface having the web adhered thereto. A creping adhesive may be deposited on the creping surface according to a predetermined pattern. The creping surface may comprise the first press surface. Optionally, the web may be calendered after being foreshortened.

19 Claims, 9 Drawing Sheets

U.S. PATENT DOCUMENTS

| | | | |
|---|---|---|---|
| 4,347,100 | 8/1982 | Brucato . | |
| 4,440,597 | 4/1984 | Wells et al. . | |
| 4,506,456 | 3/1985 | Lehtinen . | |
| 4,506,457 | 3/1985 | Lehtinen . | |
| 4,507,173 | 3/1985 | Klowak et al. . | |
| 4,514,345 | 4/1985 | Johnson et al. . | |
| 4,528,239 | 7/1985 | Trokhan . | |
| 4,529,480 | 7/1985 | Trokhan . | |
| 4,622,758 | 11/1986 | Lehtinen et al. . | |
| 4,637,859 | 1/1987 | Trokhan . | |
| 4,849,054 | 7/1989 | Klowak | 162/280 |
| 4,899,461 | 2/1990 | Lehtinen . | |
| 4,919,756 | 4/1990 | Sawdai . | |
| 4,932,139 | 6/1990 | Lehtinen . | |
| 4,958,444 | 9/1990 | Rautakorpi et al. . | |
| 5,071,513 | 12/1991 | Bluhm et al. | 162/206 |
| 5,126,015 | 6/1992 | Pounder | 162/206 |
| 5,277,761 | 1/1994 | Phan . | |
| 5,334,289 | 8/1994 | Trokhan et al. . | |
| 5,336,373 | 8/1994 | Scattolino et al. | 162/206 |
| 5,549,790 | 8/1996 | Van Phan | 162/111 |
| 5,556,511 | 9/1996 | Bluhm et al. | 162/206 |
| 5,580,423 | 12/1996 | Ampulski et al. | 162/109 |
| 5,594,997 | 1/1997 | Lehtinen . | |
| 5,607,551 | 3/1997 | Farrington, Jr. et al. . | |
| 5,709,774 | 1/1998 | Naieni . | |
| 5,795,440 | 8/1998 | Ampulski et al. . | |
| 5,814,190 | 9/1998 | Van Phan . | |
| 5,858,512 | 1/1999 | Picard et al. . | |
| 5,935,381 | 8/1999 | Trokhan et al. . | |
| 5,938,893 | 8/1999 | Trokhan et al. . | |

FOREIGN PATENT DOCUMENTS

| | | | |
|---|---|---|---|
| 2 520 770 | 8/1983 | France . | |
| 581748 | 11/1976 | Switzerland | 162/281 |
| WO 96/13635 | 5/1996 | WIPO . | |
| WO 97/43483 | 11/1997 | WIPO . | |
| WO 98/00604 | 1/1998 | WIPO . | |
| WO 98/55689 | 12/1998 | WIPO . | |

OTHER PUBLICATIONS

Patent applicaton entitled "Differential Density Cellulosic Structure and Process for Making Same" filed Jun. 6, 1997 in the name of Trokhan et al.

Patent application entitled "Fibrous Structure and Process for Making Same" filed on Aug. 15, 1997 in the name of Trokhan et al.

PROCESS AND APPARATUS FOR MAKING FORESHORTENED CELLULSIC STRUCTURE

This Application is Continuation-In-Part of both Ser. No. 08/870,535 filed Jun. 6, 1997, now U.S. Pat. No. 5,935,381, and Ser. No. 08/920,204 filed Aug. 15, 1997, now U.S. Pat. No. 5,938,893 issued Aug. 17, 1999.

FIELD OF THE INVENTION

The present invention is related to processes and apparatuses for making strong, soft, absorbent cellulosic webs. More particularly, this invention is concerned with processes and apparatuses for making foreshortened paper webs.

BACKGROUND OF THE INVENTION

Paper products are used for a variety of purposes. Paper towels, facial tissues, toilet tissues, and the like are in constant use in modern industrialized societies. The large demand for such paper products has created a demand for improved versions of the products. If the paper products such as paper towels, facial tissues, toilet tissues, and the like are to perform their intended tasks and to find wide acceptance, they must possess certain physical characteristics. Among the more important of these characteristics are absorbency, softness, and strength.

Absorbency is the characteristic of the paper that allows the paper to take up and retain fluids, particularly water and aqueous solutions and suspensions. Important not only is the absolute quantity of fluid a given amount of paper will hold, but also the rate at which the paper will absorb the fluid. Softness is the pleasing tactile sensation consumers perceive when they use the paper for its intended purposes. Strength is the ability of a paper web to retain its physical integrity during use.

There is a well-established relationship between strength and density of the web. Therefore efforts have been made to produce highly-densified paper webs. One of such methods is disclosed in the U.S. Pat. No. 4,112,586 issued Sep. 12, 1978; the U.S. Pat. Nos. 4,506,456 and 4,506,457 both issued Mar. 26, 1985; U.S. Pat. No. 4,899,461 issued Feb. 13, 1990; U.S. Pat. No. 4,932,139 issued Jun. 12, 1990; U.S. Pat. No. 5,594,997 issued Jan. 21, 1997, all foregoing patents issued to Lehtinen; and U.S. Pat. No. 4,622,758 issued Nov. 18, 1986 to Lehtinen et al.; U.S. Pat. No. 4,958,444 issued Sep. 25, 1990 to Rautakorpi et al. All the foregoing patents are assigned to Valmet Corporation of Finland and incorporated by reference herein.

Basically, the technology described in the foregoing patents uses, in a representative embodiment, a pair of moving endless bands to dry the web which is pressed and is carried between and in parallel with the bands. The bands have different temperatures. A thermal gradient drives water from the relatively hot band contacting the web towards the relatively cold band contacting the fabric into which the water condenses. While it allows production of a highly-densified, rigid, and strong paper, this method is not adequate to produce a strong and—at the same time—soft paper suitable for such consumer-disposable products as facial tissue, paper towel, napkins, toilet tissue, and the like.

It is well known in the papermaking art that the increase in the density of a paper generally decreases the paper's absorbency and softness characteristics, which are very important for the consumer-disposable product mentioned above. Foreshortening of the paper may provide increases in the paper's caliper, absorbency, and softness. As used herein, foreshortening refers to reduction in length of a dry paper web, resulting from application of energy to the web. Typically, during foreshortening of the web, rearrangement of the fibers in the web occurs, accompanied by at least partial disruption of fiber-to-fiber bonds. Foreshortening can be accomplished in any one of several ways. The most common method is creping, in which method the dried web is adhered to a smooth surface, typically the surface of the Yankee dryer drum, and then removed from the surface with a doctor blade. Such creping is disclosed in commonly-assigned U.S. Pat. No. 4,919,756, issued Apr. 24, 1992 to Sawdai, the disclosure of which patent is incorporated by reference herein. Alternatively or additionally, foreshortening may be accomplished via wet-microcontraction, as taught in commonly-assigned U.S. Pat. No. 4,440,597, issued Apr. 3, 1984 to Wells et al., the disclosure of which patent is incorporated by reference herein.

In any process where the primary purpose is to form a uniformly-densified strong paper (such for example, as a paper board), the use of foreshortening is highly-objectionable. In contrast with the methods for producing uniformly-densified papers, cellulosic structures currently made by the present assignee contain multiple micro-regions defined most typically by differences in density. The differential-density cellulosic structures are created by—first, an application of vacuum pressure to the wet web associated with a papermaking fabric, thereby deflecting a portion of the papermaking fibers to generate low-density micro-regions, and—second, pressing, for a relatively short period of time, portions of the web comprising non-deflected papermaking fibers against a hard surface, such as a surface of a Yankee dryer drum, to form high-density micro-regions. The high-density micro-regions of the resulting cellulosic structure generate strength, while the low-density micro-regions contribute softness, bulk and absorbency.

Such differential density cellulosic structures may be produced using through-air drying papermaking belts comprising a reinforcing structure and a resinous framework, which belts are described in commonly assigned U.S. Pat. No. 4,514,345 issued to Johnson et al. on Apr. 30, 1985; U.S. Pat. No. 4,528,239 issued to Trokhan on Jul. 9, 1985; U.S. Pat. No. 4,529,480 issued to Trokhan on Jul. 16, 1985; U.S. Pat. No. 4,637,859 issued to Trokhan on Jan. 20, 1987; U.S. Pat. No. 5,334,289 issued to Trokhan et al on Aug. 2, 1994. The foregoing patents are incorporated herein by reference.

Now it has been found that soft and, at the same time, strong differential-density paper webs may be successfully produced by first—highly densifying at least selected portions of the web between two press surfaces, and then—creping the web off one of the press surfaces to which the web has adhered during pressing. The commonly assigned co-pending patent applications entitled "Differential Density Cellulosic Structure and Process for Making Same" filed on Jun. 6, 1997 in the name of Trokhan et al., and "Fibrous Structure and Process for Making Same" filed on Aug. 15, 1997 in the name of Trokhan et al. are all incorporated by reference herein. It has also been found that foreshortening of the paper web may beneficially be accomplished in these processes, completely eliminating a need for the Yankee dryer drum as a creping surface.

Accordingly, it is an object of the present invention to provide an apparatus and an improved papermaking process for making a foreshortened strong and—at the same time—soft paper web, eliminating the need for a Yankee dryer.

SUMMARY OF THE INVENTION

A wet web is disposed on a fluid-permeable papermaking fabric having a web-side (in contact with the web) and a backside opposite to the web-side. The web and the fabric are pressed between two parallel and mutually opposed first and second press surfaces. The first press surface contacts the web, and the second press surface contacts the papermaking fabric's backside. The press surfaces may be flat or, alternatively, curved. If needed, an additional fabric may be provided between the papermaking fabric and the second press surface.

In a preferred continuous process, each press surface preferably comprises an endless band, and the papermaking fabric comprises an endless belt. The web and the belt are interposed between the first and second bands and pressed thereby within a press nip formed by the bands. The pressure at which the web is impressed is controlled by a pressing means which may include, but is not limited to, devices juxtaposed with the bands and pushing the bands towards each other. The pressure may also be controlled by the bands' longitudinal tension and a clearance between the sections of the bands comprising the press nip therebetween.

The web and the fabric move in a machine direction. The first press surface may be smooth or, alternatively, patterned. Similarly, the belt's web-side may be patterned. For the belt having a patterned web-side, a belt having a resinous framework joined to a reinforcing structure is preferred.

The first press surface is heated to create a temperature differential between the first and second press surfaces. The second press surface may also be heated to a lesser temperature, relative to a temperature of the first press surface. Alternatively, the second surface may be maintained at ambient temperature, or be cooled. The temperature differential causes water contained in the web to move from a relatively hot area to a relatively cold area (due to at least partial evaporation followed by condensation), e. g., from the web into the fabric, thereby dewatering the web.

Under the pressure caused by the first and second press surfaces wherein the first press surface imprints the web into the belt, at least selected portions of the web become densified and adhered to the first press surface which can be treated with a creping adhesive. The creping adhesive may be applied to the first press surface uniformly, or—alternatively—according to a pre-selected pattern. An adhesive applicator may comprise a printing roll, spraying nozzles, extrusion devices, and other devices known in the art.

After the web is released from the pressure, the web is foreshortened by a foreshortening means. Foreshortening may be accomplished by creping, by transferring the web from the first press surface to a slower moving transfer fabric, or by the combination thereof.

Creping is preferably performed with a creping doctor blade juxtaposed with the creping surface having the web adhered thereto. The creping surface may comprise the first press surface. Alternatively, the creping surface comprises a surface separate from the first press surface. While creping may be used with both the smooth crepe surface and the patterned crepe surface, preferably the creping surface is smooth in the machine direction such that the movement of the creping surface relative to the creping blade is not obstructed in the machine direction.

Foreshortening by transferring the web from the first press surface to a slower-moving transfer fabric may also be used with the both—smooth and patterned—types of the first pressing surface. The slower-moving transfer fabric has a preferred velocity in the range of from about 95% to about 75% of the velocity of the first press surface. The preferred transfer fabric comprises an endless belt, preferably having a textured web-contacting surface to provide necessary friction between the web-contacting surface of the transfer fabric and the web being transferred thereon. Preferably, the web has a consistency of at least about 30% just before the web is transferred to the transfer fabric. Optionally, the web may be calendered after being foreshortened.

While the process and the apparatus of the present invention are described herein mostly in terms of making the differential-density web, both the process and the apparatus are equally applicable for making a paper web having substantially even distribution of density.

DETAILED DESCRIPTION OF THE INVENTION

Figures 1, 1A:
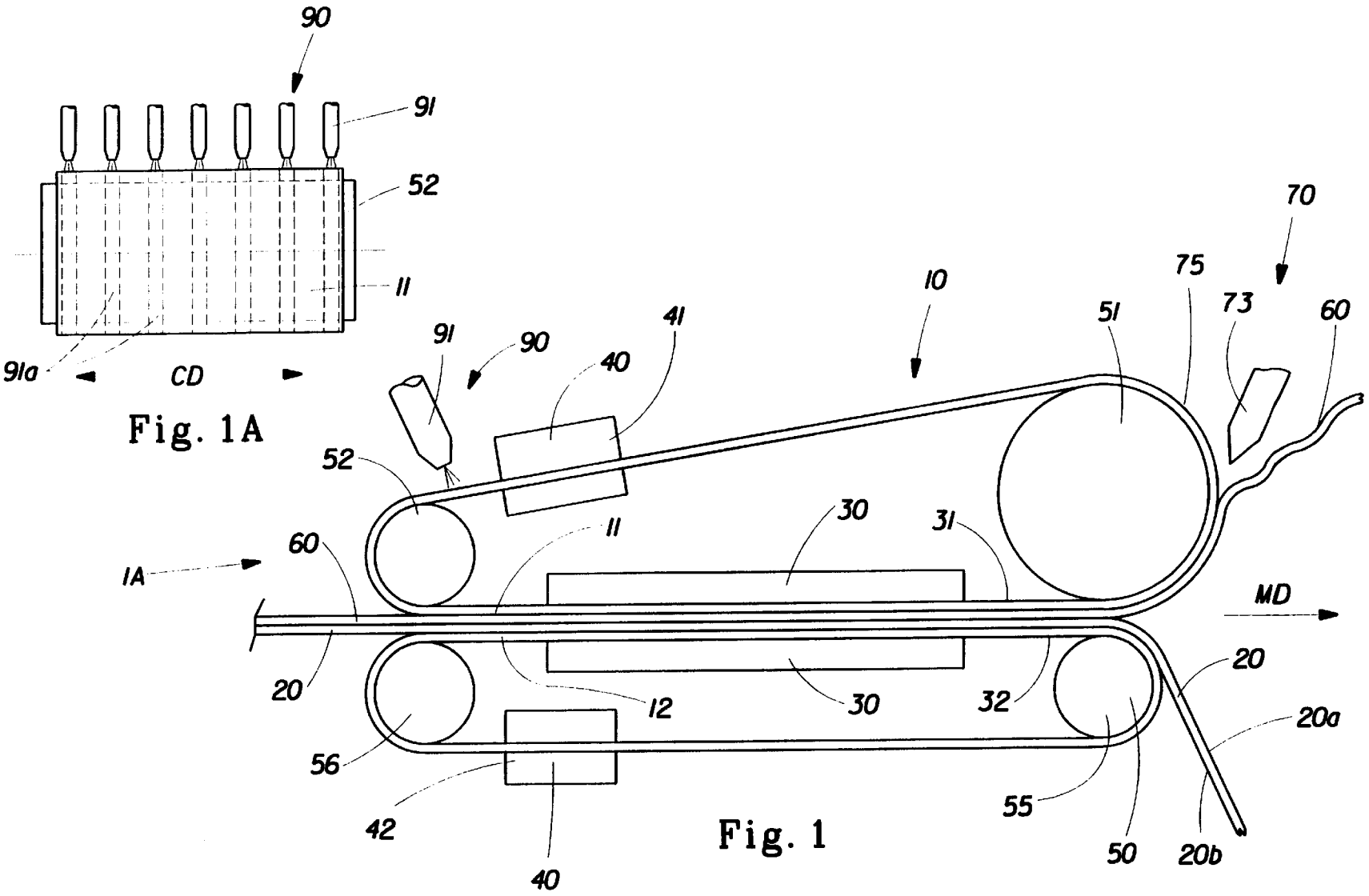
FIG. 1 is a schematic side-elevational view of one exemplary embodiment of a continuous process and an apparatus of the present invention, showing a web being foreshortened by creping with a creping doctor blade.
FIG. 1A is a schematic fragmental view of the apparatus taken along the arrow 1A in FIG. 1, and showing an adhesion applicator comprising a plurality of nozzles spraying a creping surface with an adhesive.

The process of the present invention comprises a number of steps or operations which occur in the general time sequence as noted below. It is to be understood, however, that the steps described below are intended to assist a reader in understanding the process of the present invention, and that the invention is not limited to processes with only a certain number or arrangement of steps. It is possible, and in some cases even preferable, to combine at least some of the following steps so that they are performed concurrently. Likewise, it is possible to separate at least some of the following steps into two or more steps without departing from the scope of this invention.

First, an apparatus 10 is provided, as shown in FIGS. 1–7. The apparatus 10 of the present invention comprises a first press surface 11 and a second press surface 12 parallel and opposite to the first press surface. The first and second press surfaces 11, 12 are capable of receiving therebetween a web 60 of wet cellulosic fibers in association with a papermaking fabric 20 supporting the web 60. The apparatus 10 further comprises a pressing means 30 for moving the press surfaces 11, 12 towards each other thereby pressing the web 60 and the papermaking fabric 20 between the press surfaces 11, 12 such that the first press surface 11 contacts the web 60 and the second press surface 12 contacts the fabric 20.

A means 40 for creating a temperature differential between the first press surface 11 and the second press surface 12 is provided. The means 40 for creating a temperature differential is shown schematically in several drawings as a heating apparatus 41 for heating the first press surface 11, and an optional cooling apparatus 42 for cooling a second press surface 12. The means 40 for creating a temperature differential may also comprise—alternatively or additionally—steam-heating of the first press surface 11 and/or water-cooling of the second press surface 12. Other conventional means for creating a temperature differential between the first and second press surfaces 11, 12 may also be utilized in the apparatus 10 of the present invention. Of course, the second press surface 12 does not need to be affirmatively cooled: it may be maintained having an ambient temperature, or it may even be heated to a temperature which is less than the temperature of the first press surface 11. The important factor is to maintain the temperature differential sufficient to drive the water contained in the web 60 in the direction from the first press surface 11 towards the second press surface 12, due to at least partial evaporation followed by condensation.

A transporting means 50 is provided for moving the press surfaces 11, 12, and the fabric 20 with the associated web 60 in a machine direction (MD). A variety of the transporting means, well known in the art, may be used in the apparatus 10 of the present invention.

The apparatus 10 further comprises a foreshortening means 70 for foreshortening the web 60 after the web 60 is released from the pressure between the press surfaces 11, 12. The foreshortening means 70 will be discussed in sufficient detail herein below.

As used herein, the term "papermaking fabric" is a generic term including stationary papermaking plates and endless papermaking belts. In the context of the preferred continuous processes, fragments of which are shown in FIGS. 1–7, the papermaking fabric 20 comprises an endless belt traveling in the machine direction indicated by the directional arrow MD in several drawings illustrating the present invention. As used herein, the terms "fabric" and "belt" are synonymous and interchangeable.

A variety of papermaking belts may be used as the fabric 20 in the present invention. Examples include: U.S. Pat. Nos. 4,514,345 issued to Johnson et al. on Apr. 30, 1985; 4,528,239 issued to Trokhan on Jul. 9, 1985; 4,529,480 issued to Trokhan on Jul. 16, 1985; 4,637,859 issued to Trokhan on Jan. 20, 1987; 5,334,289 issued to Trokhan et al. on Aug. 2, 1994; 5,628,876 issued to Ayers et al. on May 13, 1997, all commonly assigned and incorporated by reference herein.

Also, the commonly-assigned U.S. Pat. No. 4,239,065, issued Dec. 16, 1980, in the name of Trokhan and incorporated by reference herein, discloses the type of the belt 20 that can be utilized in the present invention. The belt disclosed in U.S. Pat. No. 4,239,065 has no resinous framework; the web-side of this belt is defined by co-planar crossovers of mutually interwoven filaments distributed in a predetermined pattern throughout the belt.

Another type of the belt which can be utilized as the belt 20 in the process of the present invention is disclosed in the European Patent Application having Publication Number: 0 677 612 A2, filed Dec. 4, 1995.

Figure 5:
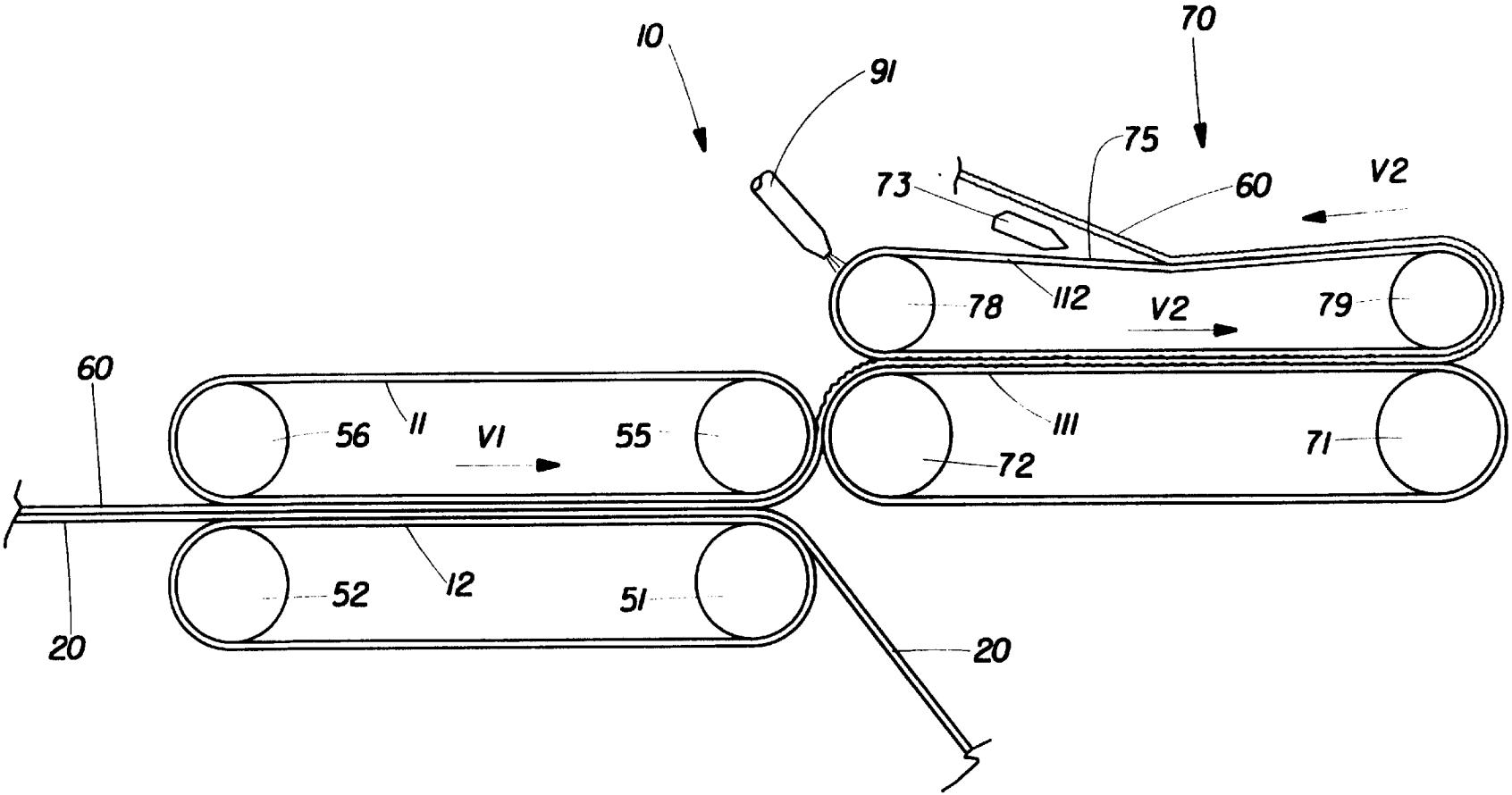
FIG. 5 is a schematic side-elevational view of a continuous process and an apparatus of the present invention, showing a web being foreshortened by transferring it from a first press surface to a transfer fabric, then pressing the web using an auxiliary press surface, and creping the web off a convex creping surface.
Figure 6:
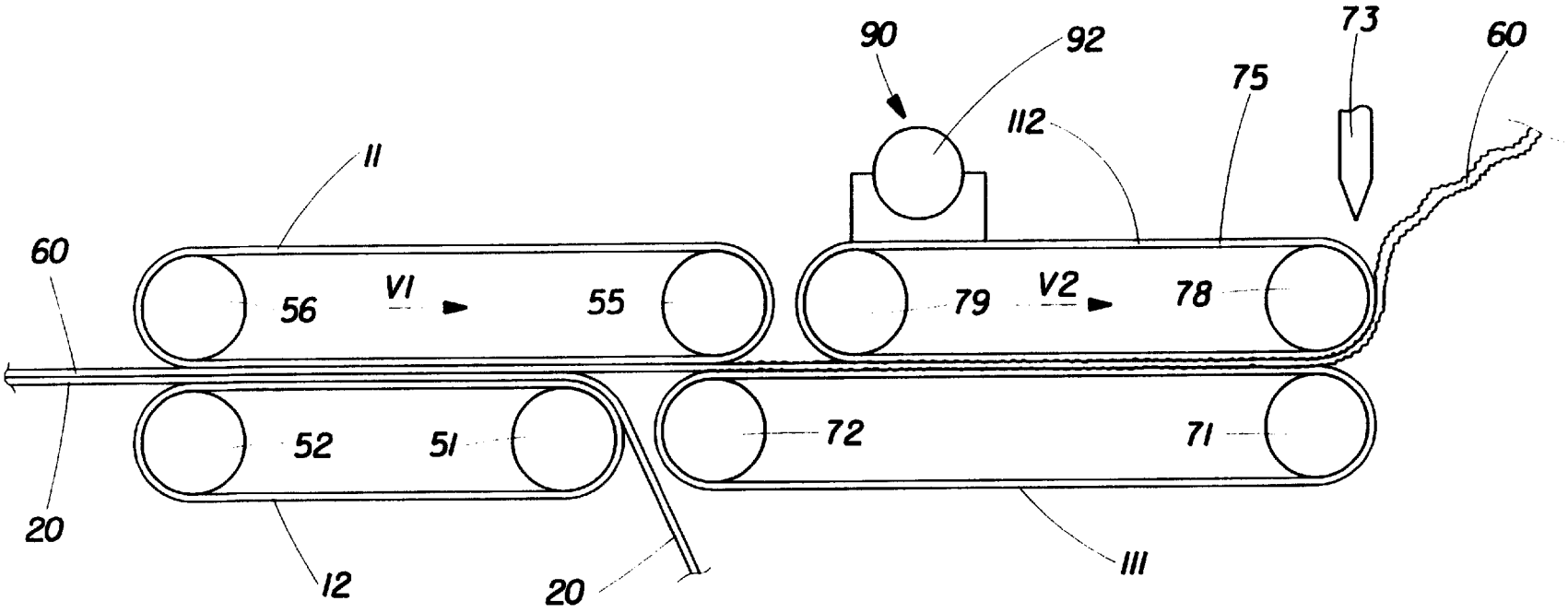
FIG. 6 is a schematic side-elevational view of a continuous process and an apparatus of the present invention, showing a web being foreshortened by transferring it from the first press surface to the transfer fabric, then pressing the web using an auxiliary press surface, and creping the web off a concave creping surface.

In the present invention, the belt 20, having a woven element as the reinforcing structure 25, as shown in FIGS. 5 and 6, is preferred. However, the belt 20 can be made using a felt as a reinforcing structure, as set forth in U.S. Pat. No. 5,556,509 issued Sep. 17, 1996 to Trokhan et al. and the patent application Ser. No. 08/391,372 filed Feb. 15, 1995 in the name of Trokhan et al. and entitled: "Method of Applying a Curable Resin to a Substrate for Use in Papermaking"; Ser. No. 08/461,832 filed Jun. 5, 1995 in the name of Trokhan et al. and entitled: "Web Patterning Apparatus Comprising a Felt Layer and a Photosensitive Resin Layer." These patent and patent applications are commonly-assigned and incorporated herein by reference.

In the preferred continuous process schematically illustrated in FIGS. 1–7, the first press surface 11 is a surface of a first endless band 31, and the second press surface 12 is a surface of a second endless band 32. The transporting means 50 are schematically illustrated as comprising rotating return rolls around which the endless bands 31 and 32 travel in the machine direction MD. The first endless band 31 travels around return rolls 51 and 52; and the second endless belt 32 travels around return rolls 55 and 56. Both the first and second bands 31, 32 have a first velocity V1 schematically indicated by the directional arrow V1 in FIGS. 1–7.

Other embodiments of the first and second press surfaces 11 and 12 may be used in the apparatus of the present invention. As has been noted in the BACKGROUND, the following U.S. patents, incorporated by reference herein, show different arrangements of the pressing surfaces or their equivalents: U.S. Pat. Nos. 4,112,586 issued Sep. 12, 1978; 4,506,456 and 4,506,457 both issued Mar. 26, 1985; 4,899,461 issued Feb. 13, 1990; 4,932,139 issued Jun. 12, 1990; 5,594,997 issued Jan. 21, 1997; 4,622,758 issued Nov. 18, 1986; and 4,958,444 issued Sep. 25, 1990. As an example, one of the first press surface 11 and the second press surface 12 may comprise a surface of a rotating cylinder (not shown).

In FIGS. 1–7, the first and second press surfaces 11, 12 define an X-Y plane. As used herein, the X-Y plane is a reference plane which is parallel to the general plane of the belt 20. A direction perpendicular to the X-Y plane is a Z-direction. Thickness of the belt 20 and caliper of the web 60 are measured in the Z-direction; and the web 60 and the belt 20 associated therewith are pressed by and between the bands 31, 32 in the Z-direction. One skilled in the art will understand that the press surfaces 11, 12 need not be planar and may comprise curved surfaces (not shown), in which instance the Z-direction is a direction normal to the tangent in any point of the curved press surfaces.

In papermaking, the machine direction MD indicates that direction which is parallel to and has the same direction as the flow of the web 60 (and therefore the belt 20) through the papermaking equipment. The cross-machine direction CD is perpendicular to the machine direction MD and parallel to the general plane of the web 60 and the belt 20. One skilled in the art will appreciate that if the press surfaces 11, 12 are curved, the machine direction MD follows the shape of the curvature of the press surfaces 11, 12.

The first and second press surfaces 11, 12 form a press nip therebetween designed to receive the belt 20 having the fibrous web 60 thereon. As used herein, the term "fibrous web" includes any web comprising cellulosic fibers, synthetic fibers, or any combination thereof. The fibrous web 60 may be made by any papermaking process known in the art, including, but not limited to, a conventional process or a through-air drying process. Suitable fibers may include recycled, or secondary, papermaking fibers, as well as virgin papermaking fibers. The fibers may comprise hardwood fibers, softwood fibers, and non-wood fibers. The final paper web produced using the apparatus and the process of the present invention preferably has a basis weight in the range between about 6 to about 40 pounds per 3000 square feet.

Of course, the step of providing the fibrous web 60 may be preceded by the steps of forming such a fibrous web, as one skilled in the art will readily understand. For example, the equipment for preparing the aqueous dispersion of the papermaking fibers is disclosed in U.S. Pat. No. 3,994,771, issued to Morgan and Rich on Nov. 30, 1976, which patent is incorporated by reference herein. The preparation of the aqueous dispersion of the papermaking fibers and the characteristics of such an aqueous dispersion are described in greater detail in U.S. Pat. No. 4,529,480 issued to Trokhan on Jul. 16, 1985, which patent is incorporated herein by reference.

The fibrous web 60 comprises a fiber-binding substance, such as, for example, fluid-latent indigenous polymers. As used herein, the term "fiber-binding substance" designates a matter capable of interconnecting the fibers of the web 60 under certain conditions, such as moisture, temperature, pressure, and time, as to create fiber bonds therebetween. Selected portions of the web 60, in which the fibers are interconnected with the fiber-binding substance, will form a first plurality of distinct micro-regions of the web, different from the rest of the web in that the rest of the web will comprise the fibers which are not interconnected with the fiber-binding substance.

As well known in the papermaking art, typically, wood used in papermaking inherently comprises cellulose (about 45%), hemicelluloses (about 25–35%), lignin (about 21–25%) and extractives (about 2–8%). G. A. Smook, *Handbook for Pulp & Paper Technologists*, TAPPI, 4th printing, 1987, pages 6–7, which book is incorporated by reference herein. Hemicelluloses are polymers of hexoses (glucose, mannose, and galactose) and pentoses (xylose and arabinose). Id., at 5. Lignin is an amorphous, highly polymerized substance which comprises an outer layer of a fiber. Id., at 6. Extractives are a variety of diverse substances present in native fibers, such as resin acids, fatty acids, turpenoid compounds, and alcohols. Id. Hemicelluloses, lignin, and extractives are typically a part of cellulosic fibers, but may be added independently to a plurality of papermaking cellulosic fibers, or web, if desired, as part of a web-making process.

As a result of mechanical and/or chemical treatment of wood to produce pulp, portions of hemicelluloses, lignin, and extractives are removed from the papermaking fibers. It is believed that when the fibers are brought together during a papermaking process, cellulose hydroxyl groups are linked together by hydrogen bonds. Smook, infra at 8. Therefore, the removal of most of the lignin, while retaining substantial amounts of hemicelluloses, is generally viewed as a desirable occurrence, because the removal of lignin increases ability of fibers to form inter-fiber bonds as well as increases absorbency of the resulting web. A process of "beating" or "refining" which causes removal of primary fiber walls also helps to increase fiber absorbency (Id., at 7), as well as increase fibers' flexibility. Although some portion of the fiber-binding substance inherently contained in the pulp is removed from the papermaking fibers during mechanical and/or chemical treatment of the wood, the papermaking fibers still retain a portion of the fiber-binding substance even after the chemical treatment. The claimed invention allows advantageous use of the fiber-binding substance which is inherently contained in the wood pulp and which has traditionally been viewed as undesirable in the papermaking process. The preferred fluid latent indigenous polymers are selected from the group consisting of lignin, hemicelluloses, extractives, and any combination thereof. Other types of the fluid-latent indigenous polymers may also be utilized if desired. European Patent Application EP 0 616 074 A1 discloses a paper sheet formed by a wet-pressing process and adding a wet-strength resin to the papermaking fibers.

Alternatively or additionally, the fluid-latent indigenous polymers may be supplied independently from the papermaking fibers and added to the web 60 (or to the fibers) before the web 60 has been formed. Independent deposition of the fluid-latent indigenous polymers in the web 60 or in the fibers may be preferred if the fibers do not inherently contain a sufficient amount of the fluid-latent indigenous polymers, or do not inherently contain the fluid-latent indigenous polymers at all (as, for example, synthetic fibers). The fluid-latent indigenous polymers may be deposited in/on the web 60 (or the fibers) in the form of substantially pure chemical compounds. Alternatively, the fluid-latent indigenous polymers may be deposited in the form of cellulosic fibers containing the fluid-latent indigenous polymers. The fluid-latent indigenous polymers may be added uniformly, or—alternatively—in discrete spots. Such discrete spots may comprise a predetermined pattern and may or may not be registered with highly-densified micro-regions of the paper web.

When the web 60 enters the press nip between the first and second press surfaces 11, 12, the web 60 preferably has a fiber-consistency in the range of from about 5% to about 60%. More preferably, the fiber-consistency of the web 60 just prior to being pressed between the press surfaces 11 and 12 (at or about the point B in FIG. 2) is from about 15% to about 50%.

The web 60 and the belt 20 are interposed between the first and second press surfaces 11, 12 such that the first press surface 11 contacts the web 60, and the second press surface 12 contacts the backside of the belt 20. A pressing means 30 presses the first and second press surfaces 11, 12 towards each other. The pressing means 30 shown in FIGS. 1–3 comprises members pressing the corresponding (in the Z-direction) sections of the bands 31 and 32 towards each other, wherein these corresponding sections form the press nip therebetween. As used herein, the bands' corresponding sections which form the press nip therebetween are defined as "nip-forming sections" of the bands 31 and 32. The pressing means 30 schematically shown in FIGS. 1–3 may operate independently from the rolls 51, 52, 55, and 56. However, depending on the desired degree of densification of the web 60, and for any given belt 20 having a certain thickness, pressing of the web 60 and the belt 20 by and between the bands 31 and 32 may be effected solely by virtue of a correctly chosen clearance between the bands 31 and 32 and their longitudinal (i. e., machine-directional) tension. In the latter instance, the pressing means 30 comprises devices controlling the clearance between the bands 31 and 32 and the bands' tension.

Figure 2:
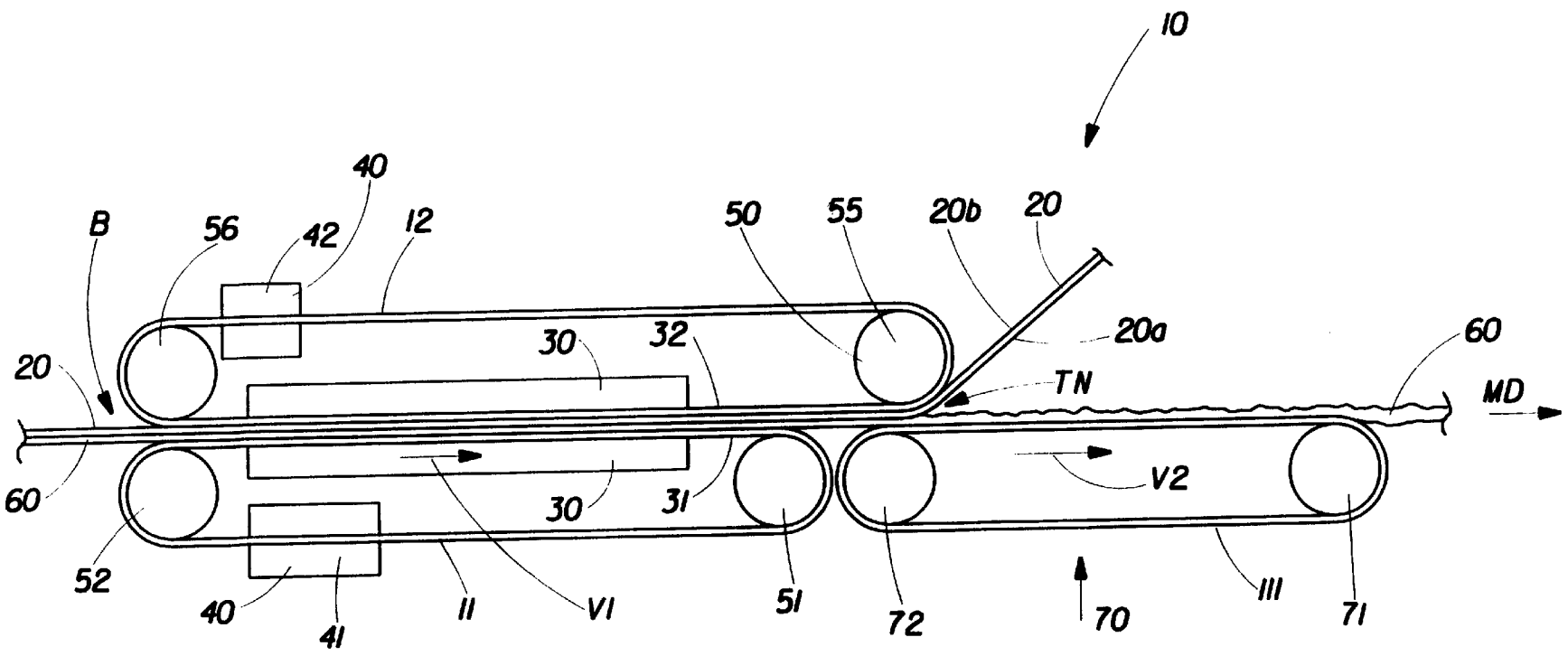
FIG. 2 is a schematic side-elevational view of a continuous process and an apparatus of the present invention, showing a web being foreshortened by transferring it from a papermaking fabric to a transfer fabric.
Figure 3:
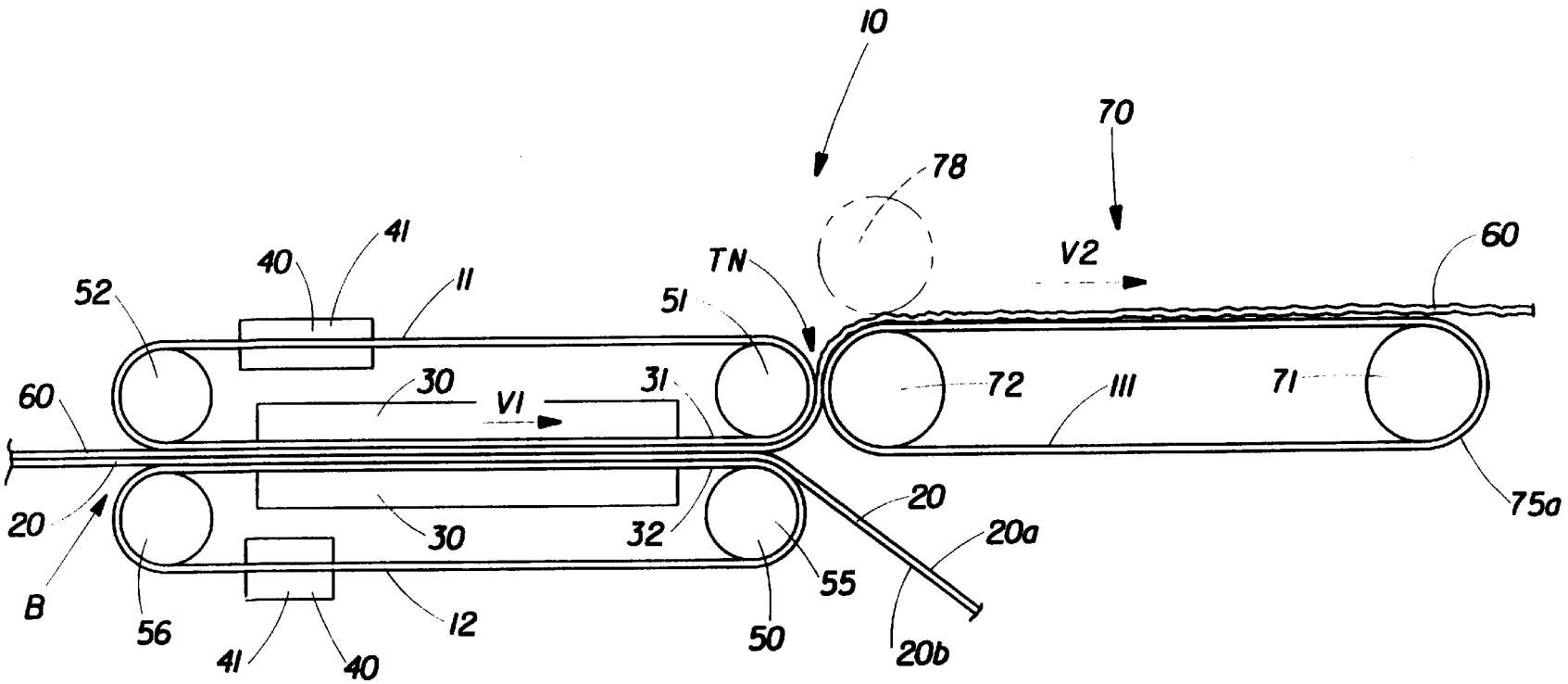
FIG. 3 is a schematic side-elevational view of another embodiment of a continuous process and an apparatus of the present invention, showing a web being foreshortened by transferring it from a first press surface to a transfer fabric.

FIGS. 1, 2, and 3 schematically show the means 40 for creating a temperature differential between the first and second press surfaces 11, 12 as comprising the heating apparatus 41 and the cooling apparatus 42. The heating apparatus 41 heats a section of the first band 31 before it comes into contact with the web 60; and the cooling apparatus 42 cools a section of the second band 32 before it comes into contact with the web 60. Thus, when the first band 31 impresses the web 60 into the belt 20, the first band 31 also heats one side of the web 60, while the second band 32 simultaneously cools the belt 20 contacting the other side of the web 60. The temperature differential drives the water contained in the web 20 from the relatively hot side to the relatively cool side, due to at least partial evaporation of the water followed by condensation. Other embodiments of the means 40, as well as other arrangements of the heating and cooling apparatuses 41, 42, well known in the art, may also be used if feasible. For example, the nip-forming section of the first band 31 may be heated when it is in contact with the web 60 (FIG. 2B), additionally or alternatively to being heated before contacting the web 60. Analogously, the nip-forming section of the second band 32 may be simultaneously cooled (not shown).

As shown above, the temperature differential created between the first and second bands 31, 32 causes the water contained in the web 60 to move from the relatively hot area to the relatively cold area, i. e., towards and into the belt 20. Therefore, the belt 20 should preferably have a sufficient amount of void volume to be able to accumulate the water driven into the belt 20 from the web 60. If necessary, an additional fabric juxtaposed with the belt 20 may be used for receiving the water driven from the web 60.

Figure 8:
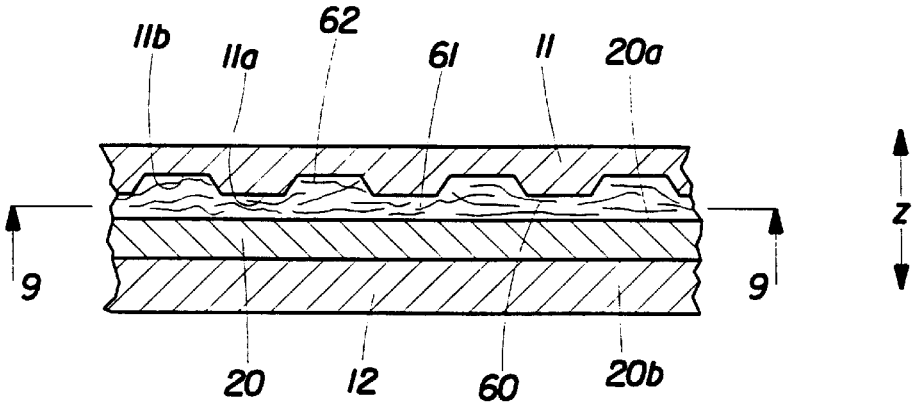
FIG. 8 is a schematic fragmental cross-sectional view of a web and a papermaking belt being pressed between a first press surface and a second press surface, the first press surface having an extending three-dimensional pattern therein.
Figure 9:
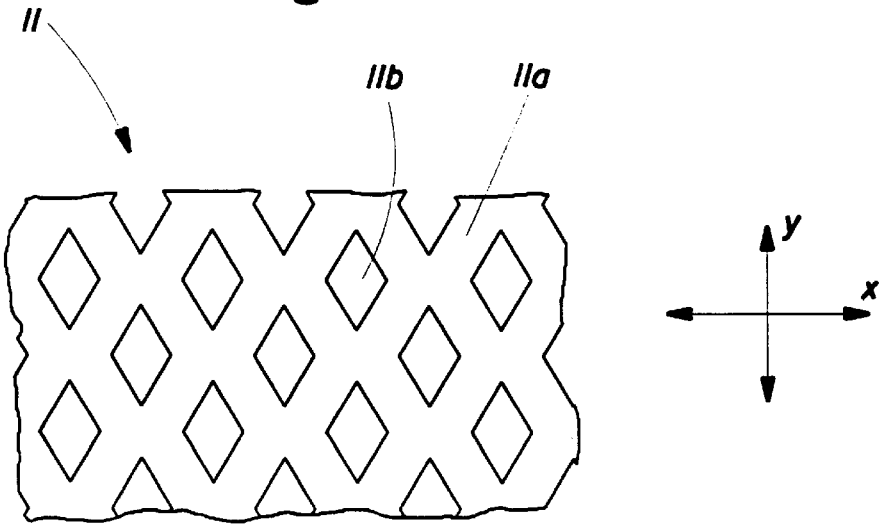
FIG. 9 is a schematic top plan view of the first press surface shown in FIG. 8, and taken along lines 9—9 of FIG. 8.

FIGS. 8 and 9 show one embodiment of the first press surface 11 which is patterned. In FIGS. 8 and 9, the first press surface 11 comprises an essentially continuous, macroscopically monoplanar, and patterned network area 11*a*, and a plurality of discrete depressions 11*b* which are dispersed throughout and encompassed by the network area 11*a*. The network area 11*a* protrudes in the Z-direction from the level of the depressions 11*b*, as best shown in FIG. 8. The continuous network 11*a* allows creping to be performed off such a network with a creping blade, as discussed in sufficient detail herein below.

As shown in FIGS. 8 and 9, selected portions 61 of the web 60 correspond (in the Z-direction) to the network area 11*a* of the first press surface 11; and portions 62 of the web 60 correspond (in the Z-direction) to the depressions 11*b* of the first press surface 11. Thus, when the first press surface 11 presses the web 60 against the belt 20, the network area 11*a* of the first press surface 11 densifies primarily the selected portions 61, leaving the rest of the web 60, including the portions 62, undensified (or densified, if desired, to a significantly lesser degree). The first press surface 11 embosses the web 60 according to a specific pattern of the network area 11*a*. In the finished paper product, the densified portions 61 of the web 60 form a continuous network 61 having a pattern which in plan view is essentially identical with the pattern of the network 11*a* of the first press surface 11. The continuous and densified network 61 of the final paper product provides strength, while the low-density portions 62 generate bulk providing softness and absorbency.

If desired, the portions 62 of the web 60 may also be impressed by the depressions 11*b* of the first press surface 11. In this instance, both the portions 61 and the portions 62 may be densified, but to a different degree. The pressure differential between the pressure applied to the portions 61 and the pressure applied to the 62 may be controlled by the distance between the surface of the network 11*a* and the surface defined by the depressions 11*b* of the patterned first press surface 11.

Figure 9A:
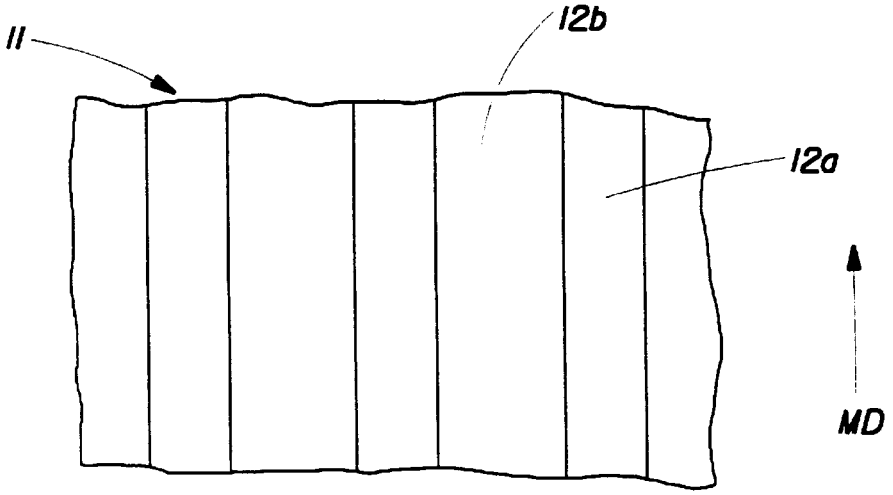
FIG. 9A is a schematic top plan view of another embodiment of the first press surface comprising longitudinal stripes extending in the machine-direction.

The patterned first press surface 11 may also comprise discrete protrusions (as opposed to depressions 11*b*), alternatively or in addition to the network 11*a*. These embodiments are not illustrated but may easily be visualized by one skilled in the art. In FIGS. 8 and 9, for example, by reversing the reference numerals 11*a* and 11*b*, one can easily visualize the network comprising depressions, and a plurality of discrete protuberances extending in the Z-direction from the network. FIG. 9A shows another embodiment of the first press surface 11. In FIG. 9A, the first press surface 11 comprises essentially continuous, machine-directional longitudinal stripes 12*a* separated by machine-directional longitudinal depressions 12*b*.

Figure 10:
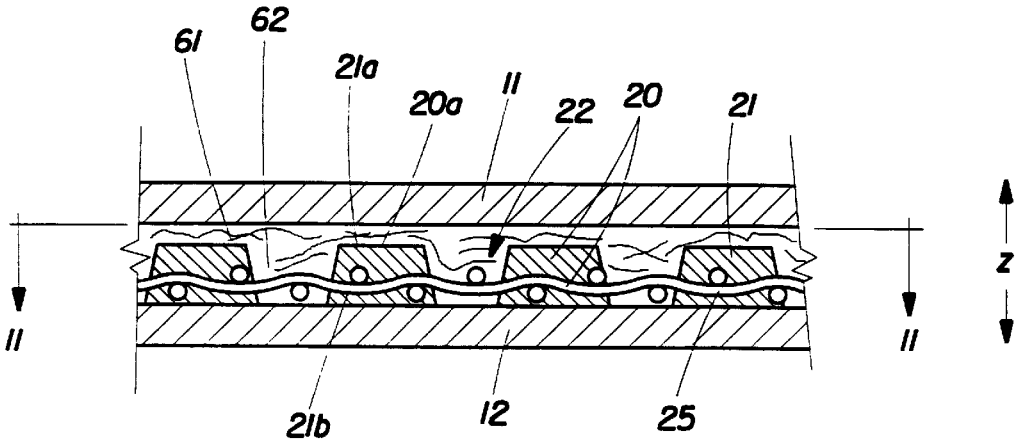
FIG. 10 is a schematic fragmental cross-sectional view of one embodiment of a papermaking belt (shown in association with the web) that may be utilized in the present invention, comprising an essentially continuous framework joined to a reinforcing structure and having discrete deflection conduits.
Figure 11:
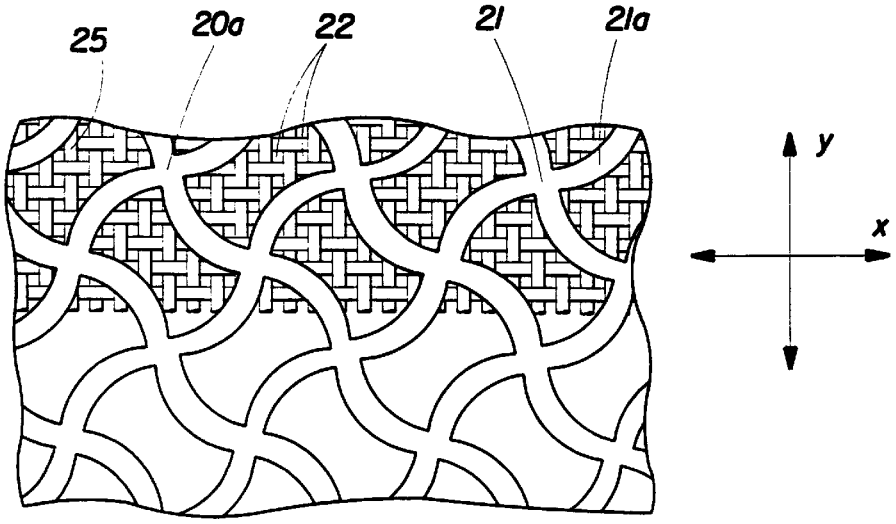
FIG. 11 is a schematic top plan view of the papermaking belt shown in FIG. 10, and taken along lines 11—11 of FIG. 10.

FIGS. 10 and 11 show the first and second press surfaces 11, 12 that are essentially unpatterned. In FIGS. 10 and 11, the belt 20 comprises a framework 21 joined to the reinforcing structure 25. The framework 21 has a web-side surface 21*a* and a backside surface 21*b*. The web-side surface 21*a* of the framework 21 defines the web-side 20*a* of the belt 20; and the backside surface 21*b* defines the backside 20*b* of the belt 20. A plurality of deflection conduits 22 extends between the web-side surface 21*a* and a backside surface 21*b* of the framework 21. The reinforcing structure 25 is positioned between the web-side surface 21*a* and the backside surface 21*b* of the framework 21. This belt is described in several commonly-assigned U.S. patents mentioned above and incorporated by reference herein. If desired, the backside 20*b* of the belt 20 may be textured according to the commonly assigned and incorporated herein by reference U.S. Pat. Nos. 5,275,700 issued Jan. 4, 1994 to Trokhan; 5,334,289 issued Aug. 2, 1994 to Trokhan et al.; 5,364,504 issued Nov. 15, 1994 to Smurkoski et al. In FIGS. 10 and 11, the selected portions 61 of the web 60, corresponding (in the Z-direction) to the web-side surface 21*a*, are pressed against the first press surface 11 and thereby densified, while the portions 62 of the web 60, corresponding in the Z-direction to the deflection conduits 22, are not subjected (or subjected to a significantly lesser degree, if desired) to densification.

In the embodiment shown in FIGS. 10 and 11, the framework 21 comprises an essentially continuous pattern, and the plurality of deflection conduits 22 comprises a plurality of discrete orifices, or holes, extending from the web-side surface 21*a* to the backside surface 21*b* of the framework 21. Preferably, the discrete conduits 22 are arranged in a pre-selected pattern in the framework 21, and more preferably, the pattern of the arrangement of the conduits 22 is non-random and repeating, such as, for example, a continuously-reticulated pattern. The papermaking belt 20 having a continuous framework 21 and discrete deflection conduits 30 is primarily disclosed in the commonly assigned and incorporated by reference herein U.S. Pat. Nos. 4,528,239 issued Jul. 9, 1985 to Trokhan; 4,529,480 issued Jul. 16, 1985 to Trokhan; 4,637,859 issued Jan. 20, 1987 to Trokhan; 5,098,522 issued Mar. 24, 1992 to Trokhan et al.; 5,275,700 issued Jan. 4, 1994 to Trokhan; 5,334,289 issued Aug. 2, 1994 to Trokhan; and 5,364,504 issued Nov. 15, 1985 to Smurkoski et al.

The belt 20 may also have the framework 21 comprising a plurality of discrete protuberances extending from the reinforcing structure 25 and separated from one another by an area of essentially continuous deflection conduits. This embodiment is not shown in the drawings but may easily be visualized by one skilled in the art. The individual protuberances may or may not have the discrete deflection conduits disposed therein and extending from the web-side surface 21*a* to the backside surface 21*b* of the framework 21. The papermaking belt 20 having the framework 21 comprising the discrete protuberances is primarily disclosed in the commonly assigned and incorporated by reference herein U.S. Pat. No. 4,245,025 issued Sep. 14, 1993 to Trokhan et al. and U.S. Pat. No. 5,527,428 issued Jun. 18, 1996 to Trokhan et al. Also, the papermaking belt 20 having the discrete protuberances raised above the plane of the fabric may be made according to the European Patent Application 95105513.6, Publication No. 0 677 612 A2, filed Dec. 4, 1995, inventor Wendt et al.

As used herein, the term "essentially continuous" indicates that interruptions in absolute geometrical continuity, while are not preferred, may be tolerable—as long as these interruptions do not adversely affect the performance of the belt 20. It should also be carefully noted that embodiments (not shown) are possible in which interruptions in the absolute continuity of the framework 21 or interruptions in the absolute continuity of the continuous conduits 22 are intended as a part of the overall design of the belt 20.

Regardless of its specific embodiment, the belt 20 is preferably fluid-pervious in at least one direction, particularly the direction from the web-side 20*a* to the backside 20*b*. As used herein, the term "fluid-pervious" refers to the condition where a liquid carrier of a fibrous slurry, or gas, such as air or steam, may be transmitted through the belt 20 without significant obstruction.

The next step in the process of the present invention comprises heating the fibrous web 60, or at least selected portions 61 of the web 60. It is believed that heating the web 60 to a sufficient temperature and for a sufficient period of time will cause the fiber-binding substance contained in the web 60 to soften. Then, under pressure applied to the selected portions 61 of the web 60 contained the fiber-binding substance, the softened fiber-binding substance becomes flowable and capable of interconnecting those papermaking fibers which are mutually juxtaposed in the selected portions 61.

The step of heating the web 60 can be accomplished by a variety of means known in the art. For example, as schematically shown in FIGS. 1, 2, and 3, the web 60 may be heated by a heating apparatus 41. A heating wire (nor shown) in contact with the web 60 may also be utilized; such principal arrangement is disclosed in U.S. Pat. No. 5,594,997 issued to Jukka Lehtinen on Jan. 21, 1997 and assigned to Valmet Corporation (of Finland). Alternatively or additionally, the web 60 can be heated by steam, as disclosed in U.S. Pat. No. 5,506,456 issued to Jukka Lehtinen on Mar. 26, 1985 and assigned to Valmet Corporation (of Finland). The disclosures of both foregoing patents are incorporated by reference herein.

The application of temperature to the web 60 may be zoned (not shown). For example, as the web 60 in association with the belt 20 passes between press surfaces 11 and 12, in a first zone (not shown) the web 60 is fast-heated to a temperature T sufficient to cause the fiber-binding substance contained in the selected portions 61 of the web 60 to soften and flow; and in a second zone (not shown) the web 60 is merely maintained at the temperature T. Such "zoned" application of temperature allows one to better control the time during which the fiber-binding substance is in a softened and flowable condition, and may provide energy-related savings. PCT Application WO 97/19223 shows one of the possible principal arrangements suitable for the process of the present invention.

The next step is applying pressure to the selected portions 61 of the web 60. The step of applying pressure is preferably accomplished by subjecting the web 60 associated with the belt 20 and the belt 20 to a pressure between two mutually opposed press surfaces: a first press surface 11 and a second press surface 12, as best shown in FIG. 8. The first and second press surfaces 11 and 12 are parallel to the X-Y plane and mutually opposed in the Z-direction. The web 60 and the belt 20 are interposed between the first press surface 11 and the second press surface 12 such that the first press surface 11 contacts the selected portions 61 of the web 60, and the second press surface 12 contacts the backside surface 20*b* of the belt 20.

The first press surface 11 and the second press surface 12 are pressed toward each other in the Z-direction. The first press surface 11 pressurizes the selected portions 61 of the web 60 against the web-facing surface 20*a* of the belt 20, thereby causing the fibers which are mutually juxtaposed in the selected portions 61 to conform to each other under the pressure. As a result of the application of the pressure, a resulting area of contact between the fibers in the selected portions 61 increases, and the softened fiber-binding substance becomes flowable and interconnects the adjacent and mutually juxtaposed fibers in the selected portions 61 of the web 60.

The steps of heating and pressurizing the web 10 may be performed concurrently. In the latter case, the first press surface 11 preferably comprises or is associated with a heating element. It is believed that simultaneous pressurizing and heating of the selected portions 61 of the web 60 facilitates softening and flowability of the fiber-binding substance in the selected portions 61 of the web 60.

Under the traditional paper-making conditions, when the web 60 is transferred to the Yankee drying drum (not shown), the residence time during which the web 60 is under pressure between the surface of the Yankee drum and an impressing nip roll is too short to effectively cause the fiber-binding substance to soften and flow. Although some densification does occur at the transfer of the web 60 to the Yankee dryer's surface at the nip between the surface of the Yankee drum and the surface of the impression nip roll, the traditional papermaking conditions do not allow to maintain the web 60 under pressure for more than about 2–5 milliseconds. At the same time, it is believed that for the purposes of causing the softened fiber-binding substance to flow and interconnect the fibers in the selected portions 61, the preferred residence time should be at least about 0.1 second (100 milliseconds).

In contrast with the traditional papermaking process, the present invention provides a significant increase in the residence time during which the web 60 is subjected to the combination of the temperature and the pressure sufficient to cause the fiber-binding substance to become flowable and interconnect the papermaking fibers in the selected (pressurized) portions 61 of the web 60. According to the process of the present invention, the more preferred residence time is greater than about 1.0 second. The most preferred residence time is in the range of between about 2 seconds and about 10 seconds. One skilled in the art will readily appreciate that at a given velocity of the belt 20, the residence time is directly proportional to the length of a path at which the selected portions 61 of the web 60 are under pressure.

While the selected portions 61 of the web 60 is subjected to the pressure between the first press surface 11 and the web-side surface 20*a* of the belt 20, the rest of the web 60 (designated herein as portions 62) is not subjected (or subjected to a lesser degree) to the pressure, thereby retaining the absorbency and softness characteristics of essentially undensified web. To be sure, the first press surface 11 may in some cases contact both the selected portions 61 and the portions 62 of the web 60. Still, even in the latter case, the portions 62 are not subjected to the process of flowing, interconnecting, and immobilization of the fiber-binding substance as the selected portions 61 are.

Prophetically, the preferred exemplary conditions that cause fiber-binding substance to soften and become flowable as to interconnect the adjacent papermaking fibers in the selected portions 61 include heating the first portion 61 of the web 60 having a moisture content of about 30% or greater (i.e., consistency of about 70% or less) to a temperature of at least 70° C. for the period of time of at least 0.5 sec. and preferably under the pressure of at least 1 bar (14.7 PSI). More preferably, the moisture content is at least about 50%, the residence time is at least about 1.0 sec., and the pressure is at least about 5 bar (73.5 PSI). If the web 60 is heated by the first press surface 11, the preferred temperature of the first press surface 11 is at least about 150° C.

The next step involves immobilization of the flowable fiber-binding substance and creating fiber-bonds between the cellulosic fibers which are interconnected in the selected portions 61 of the web 60. The step of immobilization of the fiber-binding substance may be accomplished by either cooling of the first portion 61 of the web 60, or drying of the first portion 61 of the web 60, or releasing the pressure to which the first portion 61 of the web 60 has been subjected. The three foregoing steps may be performed either in the alternative, or in combination, concurrently or consecutively. For example, in one embodiment of the process, the step of drying alone, or alternatively the step of cooling alone, may be sufficient to immobilize the fiber-binding substance. In another embodiment, for example, the step of cooling may be combined with the step of releasing the pressure. Of course, all three steps may be combined to be performed concurrently, or consecutively in any order.

One method of determining if the fiber-bonds have been formed is described in an article by Leena Kunnas, et al., "*The Effect of Condebelt Drying on the Structure of Fiber Bonds,*" *TAPPI Journal,* Vol. 76, No. 4, April 1993, which article is incorporated by reference herein.

According to the present invention, after the web 60 and the associated therewith belt 20 have been pressed between the first and second press surfaces 11, 12, the web 60 is subjected to foreshortening by a foreshortening means 70. FIGS. 1–7 show several exemplary embodiments of foreshortening the web 60 according to the present invention, which examples are intended to be neither exclusive nor exhaustive embodiments. Depending on a specific embodiment, the web 60 separates from the belt 20 either before (FIGS. 1, 3, 5, 6, and 7) or almost simultaneously with (FIGS. 2 and 4) the beginning of the step of foreshortening.

FIG. 1 shows the apparatus 10 having a foreshortening means 70 comprising a creping doctor blade 73 juxtaposed with the first press surface 11. Creping may be accomplished according to commonly assigned U.S. Pat. No. 4,919,756, issued on Apr. 24, 1992 to Sawdai, the disclosure of which is incorporated herein by reference. A conventional creping blade 73 is positioned against the creping surface so as to create an impact angle between the blade and the creping surface, wherein the impact angle ranges from about 70 degrees to about 90 degrees. A cleaning blade (well known in the art and therefore not shown) may also be used to remove contaminant build-up and excess coating from the creping surface. The web 60 preferably becomes adhered to the first press surface 11 during the step of pressing. According to the present invention, a creping adhesive may be applied directly to the creping surface. Creping adhesives comprising polyvinyl alcohol, animal-based protein glues, or mixtures thereof, well known in the art, may be utilized. The commonly-assigned U.S. Pat. No. 3,926,716 issued to Bates on Dec. 16, 1975, and incorporated herein by reference, teaches a polyvinyl alcohol creping adhesive. The U.S. Pat. No. 4,501,640 issued to Soerens on Feb. 26, 1985; U.S. Pat. No. 5,187,219 issued to Furman, Jr. on Feb. 16, 1993; U.S. Pat. No. 5,494,554 issued to Edwards et al. on Feb. 27, 1996 describe various types of creping adhesives. Optionally, various plasticizers may be used in conjunction with the creping adhesive. For example, the plasticizer commercially sold as CREPETROL R 6390 is available from Hercules Incorporated of Wilmington, Del.

The creping adhesive may be uniformly applied to the first press surface 11. Alternatively, the creping adhesive may be deposited to discrete spots, continuous areas, or combination thereof. In the instance of the non-uniform deposition of the creping adhesive, the pattern may be random or—alternatively—non-random and repeating. The non-random pattern is preferred. The discrete spots or areas may comprise a pre-selected pattern. The pre-selected pattern may be registered with the portions 61 of the web 60, which portions 61 are highly-densified relative to the rest of the web 60, including the portions 62. Such devices as a printing roll 92 (FIGS. 1, 6, 7, and 7A), spraying nozzles 91 (FIGS. 1A and 5), and extrusion devices (not shown), well known in the art, may be utilized as an adhesive applicator 90 in the present invention.

FIG. 1A schematically shows the adhesive applicator 90 comprising a plurality of spraying nozzles 91. The nozzles 91 may be arranged in the cross-machine direction so as to continuously deposit the creping adhesive in the form a plurality of separate, and generally machine-directional, strips 91*a*. Of course, the strips 91*a* need not comprise straight lines shown in FIG. 1A. One skilled in the art will understand that a reciprocal cross-directional movement of the plurality of nozzles 91 will produce a sinusoidal pattern of the strips 91*a* (not shown). The sinusoidal strips may or may not be in phase, or they may or may not be parallel to each other. A pattern is possible in which the strips are mutually intersecting. It should also be noted that the arrangement is possible in which some of the nozzles move reciprocally in the cross-machine direction, while the other nozzles do not move. Such an arrangement will produce the combination of the substantially straight strips and sinusoidal strips (not shown). Likewise, the strips 91*a* need not be continuous; interruptions in the adhesive strips 91*a* are possible and may even be desirable.

Figure 7A:
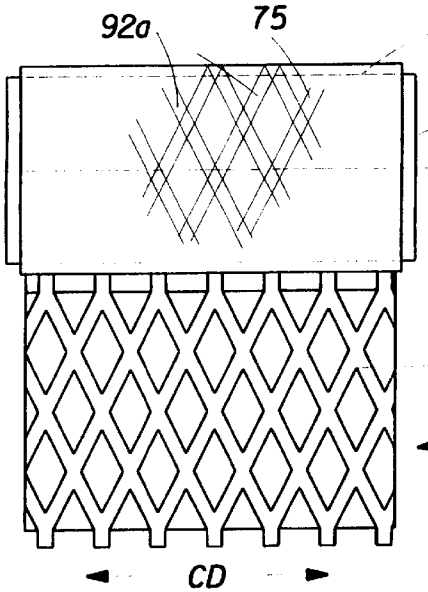
FIG. 7A is a schematic fragmental view of the apparatus taken along the arrow 7A in FIG. 7, and showing an adhesive applicator comprising a printing roll in contact with a creping surface.

FIG. 7A shows another embodiment of the adhesive applicator 90. In FIG. 7A, a printing roll 92 contacts the creping surface 75, thereby depositing the adhesive on the creping surface 75 according to a specific pre-determined pattern 92*a*. While FIG. 7A shows the printing roll having a patterned surface, a printing roll having a smooth surface may also be used for applying the adhesive to the first press surface 11, such as, for example, the first press surfaces 11 shown in FIGS. 9 and 9A. Because the first press surfaces 11 shown in FIG. 9 and 9A comprise elements extending in the Z-direction, the printing roll having a smooth surface will deposit the adhesive only (or primarily) on the surfaces of such extending elements.

Other methods of applying the adhesive to the creping surface, well known in the art, may also be utilized in the present invention. For example, U.S. Pat. No. 3,911,173 issued Oct. 7, 1975 to Sprague, Jr., U.S. Pat. No. 4,031,854 issued Jun. 28, 1977 to Sprague, Jr., and U.S. Pat. No. 4,098,632 issued Jul. 4, 1978 to Sprague, Jr. teach a spiral adhesive deposition nozzle. These nozzles utilize a circumferentially oriented plurality of air jets to induce a spiral pattern to the filament of adhesive as it is discharged from the nozzle and extrudes to the face of the lamina to be adhesively joined.

U.S. Pat. No. 4,949,668 issued Aug. 21, 1990 to Heindel, et al. discloses an apparatus for depositing hot melt adhesive onto a substrate in a semi-cycloidal pattern. The semi-cycloidal pattern closely controls the cross-directional positioning of the adhesive filament to reduce overspray and waste.

U.S. Pat. No. 4,891,249 issued Jan. 2, 1990 to McIntyre and U.S. Pat. No. 4,996,091 issued Feb. 26, 1991 to McIntyre disclose an apparatus and process for generating fluid fiber adhesive droplets and combinations of fibers and droplets. The fibers, droplets and combinations thereof are generated by funneling a cone of pressurized air symmetrically about the adhesive filament. This results in a pattern of randomly laid crisscrossing fiber deposits onto the face of the lamina.

Commonly assigned U.S. Pat. No. 5,143,776, issued Sep. 1, 1992 to Givens and incorporated herein by reference teaches the adhesive applied in a longitudinally oriented stripe. The stripe is deposited either in a spiral pattern, or, preferably, in a melt blown pattern.

The patterned application of the adhesive to the creping surface may be beneficial because it allows one to control the level of adhesion of the web 60 to the creping surface. The degree to which the web is adhered to the creping surface prior to creping with the creping blade is believed to be one of the key factors determining softness, bulk, absorbency, and stretchability of the paper web after creping. The patterned application of the adhesive to the creping surface creates conditions for differential adhesion of the paper web to the creping surface, and thus—for creating a paper web having differential regions.

According to the present invention, the creping surface may have different shapes: convex (FIGS. 1 and 6), flat (FIG. 7), and concave (FIG. 5). The concave creping surface 75 shown in FIG. 5 may be formed as a result of the pressure caused by the creping blade 73. Alternatively or additionally, the concave creping surface may be formed independently from the pressure caused by the creping blade. To form a flat creping surface, it may be beneficial to provide a support for the creping surface in the area where the creping blade contacts the creping surface. FIG. 7A shows the creping surface 75 supported by a roll 77 in the area where the creping blade 73 is juxtaposed with the creping surface 75.

The creping blade 73 may comprise a serrated pattern. U.S. Pat. Nos. 5,656,134, issued Aug. 12, 1997 to Marinack et al.; 5,685,954, issued Nov. 11, 1997 to Marinack et al.; and 5,690,788, issued Nov. 25, 1997 to Marinack et al. disclose a creping blade having an undulatory rake surface having through-shaped serrulations.

FIGS. 2–7 show the process and the apparatus of the present invention, wherein the step of foreshortening comprises transferring the web 60 from the papermaking belt 20 and/or the first press surface 11 to a transfer fabric 111. The transfer fabric 111 receives the web 10 after the web 60 has been pressed within the press nip between the first and second press surfaces 11, 12. FIGS. 2–7 schematically show several embodiments of the foreshortening means comprising the transfer fabric 111 moving at a second velocity V2. The second velocity V2 is less than the first velocity V1.

U.S. Pat. No. 4,440,597, commonly assigned and incorporated by reference herein, describes in detail "wet-microcontraction." Briefly, wet-microcontraction involves transferring the web having a low fiber-consistency from a first member (such as a foraminous member) to a second member (such as a loop of open-weave fabric) moving slower than the first member. According to U.S. Pat. No. 4,440,597, the preferred consistency of the web prior to the transfer is from about 10% to about 30% fibers by weight, and the most preferred consistency is from about 10% to about 15%.

Now, it is believed that the velocity differential can be successfully utilized to foreshorten a web having the fiber-consistency which is significantly higher relative to the fiber-consistency of the web used in the wet-microcontraction method described in the above-referenced patent. It is believed that the Z-directional pattern of the web 60 creates conditions for "microcontracting" even the relatively dry web 60 in and around the web's areas 62, which are not densified or densified to a significantly lower degree relative to the areas 61. In accordance with the present invention, the preferred fiber-consistency of the web 60 after it has been pressed between the first and second press surfaces 11, 12 and before it was transferred to the transfer fabric 111 is at least 30%. The preferred velocity differential V2/V1 is from about 0.95 to about 0.75 (meaning that the second speed V2 is from about 5% to about 25% lower than the first velocity V1). The preferred transfer fabric 111 comprises an endless belt having a textured web-receiving surface. The papermaking belts made by the present assignee according to several patents referenced herein may be used as the transfer fabric 111.

In the embodiment shown in FIG. 2, the belt 20 carries the web 60 from the press nip formed between the first and the second press surfaces 11, 12 to the transfer fabric 111. The roll 55 with the associated second band 32, and the roll 72 with the associated transfer fabric 111 form a transfer nip therebetween into which the web 60 is continuously directed. More precisely, the transfer nip is formed between the papermaking belt 20 and the transfer fabric 111 in the area TN in FIG. 2. The transfer nip is designed to receive the web 60. The transfer fabric 111 may be treated with adhesive to facilitate adherence of the web 60 to the transfer fabric 111 thereby assisting the separation of the web 60 from the belt 20.

In the embodiment shown in FIG. 3, the web 60 is continuously directed into the transfer nip formed in the area TN between the roll 51 having the associated first band 31 thereon and the roll 72 having the associated transfer fabric 111 thereon. More precisely, in FIG. 3, the transfer nip is formed between the first band 31 and the transfer fabric 111, to receive the web 60.

After the web 60 has been transferred to the transfer fabric 111, an additional pressure may be utilized to facilitate adherence of the web 60 to the transfer fabric 111. As an example, in FIG. 3 the additional pressure is caused by an optional rotating pressure roll 78 juxtaposed with the roll 72 and engaging the web 60 interposed between the pressure roll 78 and the transfer fabric 111.

Figure 4:
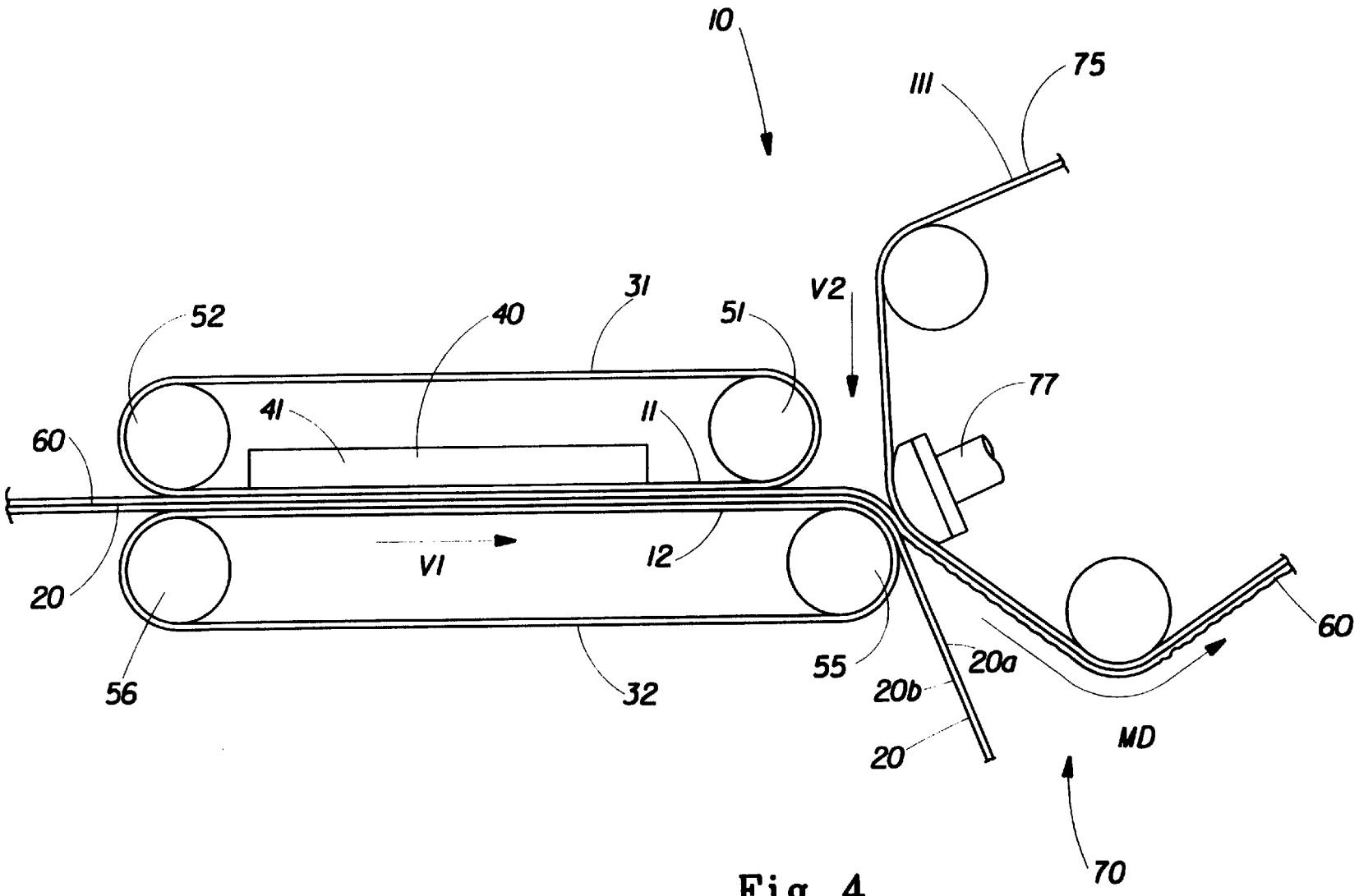
FIG. 4 is a schematic side-elevational view of a continuous process and an apparatus of the present invention, showing a web being foreshortened by transferring it from a papermaking fabric to a transfer fabric, using a vacuum pick-up shoe.

FIG. 4 shows another embodiment of the apparatus 10, in which the transfer of the web 60 from the belt 20 to the transfer fabric 111 is effected by a vacuum apparatus, such as, for example, a vacuum pick-up shoe 77. In addition to the vacuum pick-up shoe 77, other suitable vacuum equipment, such for example as vacuum boxes (not shown), well-known in the art, may be used to transfer the web 60 from the belt 20 to the transfer fabric 111. The vacuum transfer is well-known in the papermaking arts and therefore is not described in detail herein.

FIGS. 5 and 6 show still another embodiment of the present invention. In FIGS. 5 and 6, the web 60, after being released from the pressure between the first and second press surfaces 11, 12, is transferred to the transfer fabric 111 (shown as forming a loop around rolls 71 and 72). An auxiliary pressing surface 112 is interposed with the transfer fabric 111 to form a second press nip between the transfer fabric 111 and the auxiliary pressing surface 112. Pressing means, similar to those applied with regard to the first and second press surfaces 11, 12, may be used to effect pressing the transfer fabric 111 and the auxiliary pressing surface 112 towards each other. As has been pointed out above, the velocity V2 of the transfer fabric 111 and the auxiliary pressing surface 112 is less than the velocity V1 of the first and second press surfaces 11, 12. It should also be noted that in both FIG. 5 and FIG. 6, the auxiliary pressing surface 112 comprises the creping surface 75.

Figure 7:
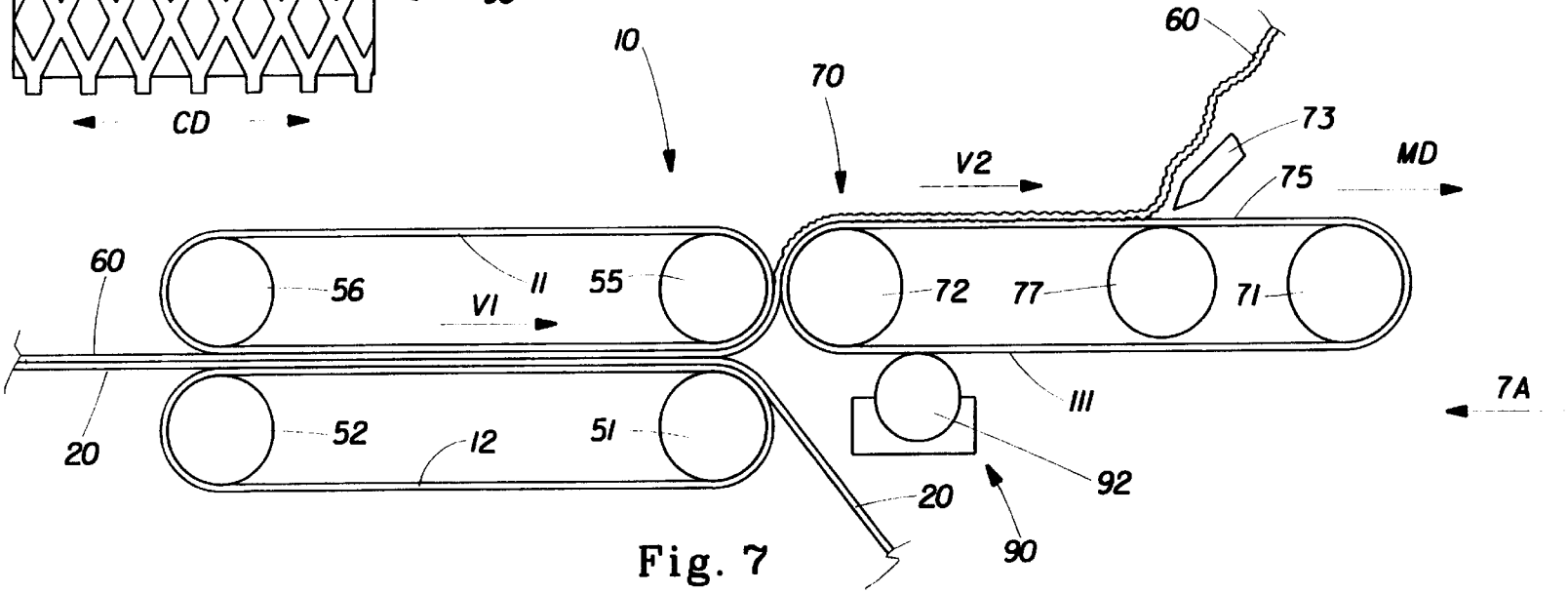
FIG. 7 is a schematic side-elevational view of a continuous process and apparatus of the present invention, showing a web being foreshortened by transferring it from the first press surface to the transfer fabric, and then creping the web off the flat creping surface.

In the present invention, the creping surface 75 may comprise the first press surface 11, as shown in FIG. 1. The creping surface 75 may also comprise the transfer fabric 111 (FIG. 7). In the embodiments shown in FIGS. 5–7, the web 60 is transferred from the association with the first press surface 11 to the creping surface 75. As shown in FIGS. 5–7, the transferal of the web 60 to the creping surface 75 may involve foreshortening by microcontraction of the web 60, wherein a velocity differential exists between the first press surface 11 and the transfer fabric 111.

Intermediate belts, separate from both the papermaking belt 20 and the transfer fabric 111, may also be used in the present invention. U.S. Pat. No. 5,607,551, issued on Mar. 4, 1997 to Farrington and assigned to Kimberly-Clark Corporation is incorporated by reference herein. Also, the transferal of the web 60 from the belt 20 to the transfer fabric 111 may be accomplished by using a transfer gap between the belt 20 and the fabric 111. PCT Application WO 96/13635, published on May 9, 1996, shows a method of using such a transfer gap.

The process and the apparatus of the present invention may be utilized in making a paper web having no differential density regions. In this instance, both the first press surface 11 and the web-side 20*a* of the belt 20 should preferably be smooth, as one skilled in the art will readily appreciate. Regardless of the type of the paper web made by the proposed apparatus and process, the web 60 may optionally be calendered after being foreshortened.

What is claimed is:

1. A process for making a foreshortened single lamina fibrous web having selected micro-regions formed by fibers interconnected with a fiber-binding substance, said process comprising the steps of:

(a) providing a fibrous web comprising a fiber-binding substance and water;

(b) providing a macroscopically monoplanar papermaking belt having a web-side surface defining an X-Y plane, a backside surface opposite said web-side surface, and a Z-direction perpendicular to said X-Y plane;

(c) depositing said fibrous web on said web-side surface of said papermaking belt;

(d) heating at least selected portions of said fibrous web thereby causing softening of said fiber-binding substance in said selected portions;

(e) applying pressure to said selected portions, thereby causing said fiber-binding substance in said selected portions to flow and interconnect said fibers which are mutually juxtaposed in said selected portions;

(f) immobilizing said fiber-binding substance and creating fiber-bonds between said fibers which are interconnected in said selected portions thereby forming a first plurality of micro-regions from said selected portions of said fibrous web;

(g) foreshortening said fibrous web to form said foreshortened single lamina fibrous web.

2. The process according to claim 1, wherein said step of depositing said fibrous web on said web-side surface of said papermaking belt comprises moving said papermaking belt in a machine direction at a first velocity.

3. The process according to claim 2, wherein said step of foreshortening comprises foreshortening said web by creping.

4. The process according to claim 2, wherein said step of applying pressure to said selected portions of the web comprises a step of impressing said web disposed on said papermaking belt between a first press surface and a second press surface, said first press surface contacting said web and said second press surface contacting said backside of said belt.

5. The process according to claim 4, wherein said step of applying pressure to said selected portions of the web further comprises a step of moving said first and second press surfaces in a machine direction at a first velocity.

6. The process according to claim 5, wherein in said step of applying pressure to said selected portions of the web said first press surface and said second press surface are mutually parallel.

7. The process according to claim 5, wherein said step of foreshortening comprises steps of adhering said web to said first press surface and creping said web off said first press surface with a creping blade.

8. The process according to claim 7, wherein said step of adhering said web to said first press surface comprises a step of depositing a creping adhesive to said first press surface in a substantially uniform pattern.

9. The process according to claim 7, wherein said step of adhering said web to said first press surface comprises a step of depositing a creping adhesive to said first press surface in an essentially non-random and repeating pattern.

10. The process according to claim 9, wherein said step of depositing a creping adhesive to said first press surface comprises depositing said creping adhesive to said first surface in a substantially continuous pattern.

11. The process according to claim 7, wherein said step of adhering said web to said first press surface comprises a step of depositing a creping adhesive to said first press surface in a non-uniform pattern.

12. The process according to claim 7, wherein said step of adhering said web to said first press surface comprises a step of depositing a creping adhesive to said first press surface at discrete spots.

13. The process according to claim 2, wherein said step of foreshortening comprises transferring said web from said papermaking fabric to a transfer fabric moving at a second velocity which is less that said first velocity.

14. The process according to claim 4, wherein said step of impressing said web disposed on said papermaking belt between a first press surface and a second press surface comprises a step of providing said first press surface having a patterned and macroscopically monoplanar area.

15. The process according to claim 14, wherein said step of impressing said web disposed on said papermaking belt between a first press surface and a second press surface comprises a step of providing said first press surface having an essentially continuous network area.

16. A process for making a foreshortened single lamina fibrous web comprising fibers and having at least a first plurality of micro-regions comprising said fibers interconnected with a fiber-binding substance in said first plurality of micro-regions, and a second plurality of micro-regions comprising said fibers not interconnected with said fiber-binding substance in said second plurality of micro-regions, said process comprising the steps of:

(a) providing said fibers;

(b) providing a macroscopically monoplanar papermaking belt having a web-side surface defining an X-Y plane, a backside surface opposite said web-side surface, and a Z-direction perpendicular to said X-Y plane;

(c) providing said fiber-binding substance;

(d) depositing said fibers and said fiber-binding substance to said webside surface of said papermaking belt to form a fibrous web comprising said fiber-binding substance;

(e) heating at least selected portions of said fibrous web to cause softening of said fiber-binding substance in said selected portions;

(f) applying pressure to said selected portions of said fibrous web in said Z-direction, thereby densifying said selected portions of said fibrous web and causing said fiber-binding substance in said selected portions to flow and interconnect said fibers which are mutually juxtaposed in said selected portions; and (g) immobilizing said fiber-binding substance and creating fiber-bonds in said selected portions between said fibers which are interconnected in said selected portions thereby forming said first plurality of micro-regions from said selected portions;

(h) foreshortening said web comprising said fiber-bonds formed in said first plurality of micro-regions.

17. The process according to claim 16, wherein said step of providing a macroscopically monoplanar papermaking belt comprises a step of providing a belt comprising deflection conduits extending between said web-side surface and said backside surface of said belt, said deflection conduits having web-side openings.

18. The process according to claim 17, further comprising the step of applying a fluid pressure differential to said web such as to leave said first portion of said fibrous web on said web-side surface of said belt while deflecting said second portion of said fibrous web into said deflection conduits, said step of applying a fluid pressure differential to said web being performed prior to the step of heating.

19. A yankeeless process for making a foreshortened single lamina fibrous web having at least a first plurality of micro-regions comprising fibers interconnected with a fiber-binding substance in said first plurality of micro-regions, and a second plurality of micro-regions comprising said fibers not interconnected with said fiber-binding substance in said second plurality of micro-regions, said process comprising the steps of:

(a) providing a macroscopically monoplanar papermaking belt having a web-side surface defining an X-Y plane, a backside surface opposite to said web-side surface, and a Z-direction perpendicular to said X-Y plane;

(b) providing said fiber-binding substance;

(c) depositing said fibers and said fiber-binding substance to said webside surface of said papermaking belt to form a fibrous web comprising said fiber-binding substance;

(d) providing a first press surface and a second press surface, said press surfaces being mutually parallel and configured to receive therebetween said belt having said fibrous web thereon such that said first press surface contacts said web and said second press surface contacts said belt, at least one of said web-side surface of said belt and said first press surface comprising a patterned framework extending in said Z-direction;

(e) heating said first press surface to cause softening of said fiber-binding substance in said web;

(f) impressing said web and said belt between said first and second press surfaces, thereby densifying said selected portions of said web in said Z-direction and causing said fiber-binding substance in said selected portions to flow and interconnect said fibers which are mutually juxtaposed in said selected portions;

(g) immobilizing said fiber-binding substance and creating fiber-bonds in said selected portions between said fibers which are interconnected in said selected portions, thereby forming said first plurality of micro-regions from said selected portions;

(h) adhering said web to said first press surface; and (i) creping said web off said first surface with a creping blade.

* * * * *